United States Patent [19]

Tsuji et al.

[11] Patent Number: 4,953,574

[45] Date of Patent: Sep. 4, 1990

[54] HAIR CURLER WITH A CLAMPING MEMBER

[75] Inventors: Eiji Tsuji, Hikone; Hideharu Nakano, Oomihachiman, both of Japan

[73] Assignee: Matsushita Electric Works, Ltd., Kadoma, Japan

[21] Appl. No.: 357,649

[22] Filed: May 24, 1989

Related U.S. Application Data

[63] Continuation of Ser. No. 4,739, Jan. 20, 1987, abandoned.

[30] Foreign Application Priority Data

Jan. 20, 1986 [JP] Japan ..... 61-9295

[51] Int. Cl.[5] ..... A45D 1/04

[52] U.S. Cl. ..... 132/232; 219/225; 219/226

[58] Field of Search ..... 132/227, 229, 232, 233, 132/234; 219/222, 225, 226

[56] References Cited

U.S. PATENT DOCUMENTS

| | | | |
|---|---|---|---|
| 2,021,294 | 11/1935 | Durham | 219/222 |
| 2,500,554 | 3/1950 | MacDonald et al. | 219/222 |
| 3,918,465 | 11/1975 | Barradas | 132/37 R |
| 4,151,401 | 4/1979 | Van Bokestal et al. | 219/222 |
| 4,163,143 | 7/1979 | Federico et al. | 132/37 R |
| 4,456,815 | 6/1984 | Andis | 219/225 |
| 4,464,562 | 8/1984 | Takimae | 219/225 |
| 4,641,010 | 2/1987 | Abura | 219/225 |
| 4,697,066 | 9/1987 | Glucksman | 219/225 |

FOREIGN PATENT DOCUMENTS

| | | | |
|---|---|---|---|
| 0111372 | 11/1917 | United Kingdom | 219/222 |
| 0228399 | 2/1925 | United Kingdom | 219/226 |
| 2154408 | 9/1985 | United Kingdom | 219/222 |

*Primary Examiner*—Gene Mancene
*Assistant Examiner*—Adriene B. Lepiane
*Attorney, Agent, or Firm*—Armstrong, Nikaido, Marmelstein, Kubovcik & Murray

[57] ABSTRACT

A hair curler has a barrel with an exposed heating element and a clamping member which clamps hair to the heating element exposed on the barrel for providing tight curls. The heating element is in the form of a plurality of resistor segments extending lengthwise of the barrel and being spaced circumferentially around the barrel with the longitudinal ends thereof being connected. The resistor segments, which are mounted at one circumferential portion of the barrel in closely adjacent relation to the clamping member, are arranged to give off a greater amount of heat than the remaining resistor segments mounted at the other circumferential portion of the barrel located away from the clamping member.

2 Claims, 8 Drawing Sheets

HAIR CURLER WITH A CLAMPING MEMBER

This application is a continuation of application Ser. No. 004,739 filed Jan. 20, 1987 and abandoned May 24, 1989.

1. Field of the Invention

BACKGROUND OF THE INVENTION

The present invention is directed to a hair curler with a clamping member, and more particularly to a hair curler including a barrel with an exposed heating element and a hair clamping member adapted to clamp hair to the heating element on the exterior of the barrel.

2. Description of the Prior Art

A hair curler having an exposed heating element on a barrel about which the hair is wound for giving curls is known in the art such as proposed in U.S. Pat. application S.N. 697,934 filed on Feb. 4, 1985, now U.S. Pat. No. 4,641,010 and assigned to the same assignee of the present invention. Another hair curler having a heating element on the exterior of a barrel and further including a hair clamping member is disclosed in U.S. Pat. No. 4,456,815 issued to Andis.

When the clamping member is utilized for clamping hair to the heating element on the exterior of the barrel, it is generally desired to supply a greater amount of heat to the hair held by the clamping member for giving a tight curl thereto. Although the provision of the exposed heating element is advantageous in reducing the heat energy requirement because of its direct heat transfer relation to the hair wound on the barrel, the exposed heating element is very likely to wastefully dissipate its heat to the clamping member located adjacent thereto, resulting in considerable heat loss and failing to give enough amount of heat to the hair intended to be tight curled. It is therefore mostly required that the heating element produces a greater amount of heat at one circumferential portion of the barrel located adjacent to the clamping member for concentrating the heat to the hair clamped or at least compensating for the heat loss thereat. In this respect, neither of the above prior art curlers provides a scheme of differentiating the amount of the heat to be produced at the portion adjacent to the clamping member from that at the remaining portion of the barrel.

SUMMARY OF THE INVENTION

The present invention has been accomplished in view of the above and provides an improved hair curler with a hair clamping member. The hair curler in accordance with the present invention includes a barrel provided with a heating element extending along the exterior surface thereof and includes a hair clamping member pivotally mounted on one end of the barrel for clamping hair to the heating element on the barrel. The heating element is a resistance element in the form of a plurality of circumferentially spaced resistor segments which extend lengthwise of the barrel in a generally parallel relation to each other with the longitudinal ends thereof being kept connected. The hair clamping member has a clamping plate section which extends lengthwise of the barrel and fit over one circumferential portion of the barrel in closely adjacent relation thereto. The characterizing feature of the present invention resides in that the heating element is arranged to produce a greater amount of heat at the certain segments located closely adjacent to the clamping plate section than at the remaining segments located away therefrom.

With this arrangement, the one circumferential portion of the barrel located closely adjacent to the clamping plate section can give off a greater amount of heat than the remaining portion, thereby applying a greater amount of heat to the hair held between the barrel and the clamping plate section or at least compensating for the heat loss due to the heat dissipation to the clamping plate section from the corresponding segments of the heating element. Thus, the hair clamped by the clamping plate section can be successfully formed into an intended tight curled finish. This permits the combined use of the exposed heating element and the hair clamping member in a successful manner as to ensure an effective formation of tight curls, while retaining the advantage arising from the employment of the exposed heating element that it requires less heat energy and therefore makes the curler most suitable for portable use.

Accordingly, it is a primary object of the present invention to provide an improved hair curler in which the exposed heating element is successfully coordinated with the hair clamping member to form tight curls in an effective manner.

In a preferred embodiment, the heating element is arranged to have its resistor segments electrically connected in a series-parallel combination across an electric source. The series combination of the resistor segments is disposed on the portion of the barrel located closely adjacent to the clamping plate section or surrounded thereby so as to produce a greater amount of heat thereat than at the parallel combination of the resistor segments disposed on the other portion of the barrel located away from the clamping plate section or not surrounded thereby.

It is therefore another object of the present invention to provide an improved hair curler in which the heating element is made of the plural resistor segments connected in series-parallel combination for effectively differentiating the amount of heat produced on the desired circumferential portion of the barrel from that on the other portion of the barrel.

In another preferred embodiment, the heating element is arranged to have its resistor segments circumferentially spaced at a closer interval on the portion of barrel located closely adjacent to the clamping plate section than on the portion located away therefrom. With this result, the portion of the barrel adjacent the clamping plate section can supply a greater amount of heat to the hair than the other portion, giving rise to the above heat producing effect.

It is therefore a further object of the present invention to provide an improved hair curler in which the heating element has the plurality of segments effectively disposed at different spacings around the barrel to produce a greater amount of heat on the portion of the barrel adjacent the clamping plate section.

In addition to the above provision of narrowing the spacing between the adjacent resistor segments on the portion of the barrel adjacent the clamping plate section from the other portion, the heating element may be formed to have the resistor segments of narrower width on the portion of the barrel adjacent the clamping plate section than the remaining resistor segments. This will amplify the above effect of differentiating the amount of heat produced on the particular portion of the barrel from the other portion, further improving the curling effect by the use of the hair clamping member, which is a still further object of the present invention.

Also disclosed in the present invention is a further advantageous feature of providing a stopper nub on the portion of the barrel located adjacent to the clamping plate section. The stopper nub projects radially outwardly beyond the adjacent resistor segments to abut against the clamping plate section for preventing the direct contact between the resistor segments and the clamping plate section. This can certainly reduce the amount of heat to be dissipated to the clamping plate section from the corresponding segments on the adjacent portion of the barrel, thus preventing the heat loss thereat and effectively concentrating the heat to the hair clamped by the clamping plate section to facilitate the curling treatment, which is therefore a still further object of the present invention.

These and other advantageous features will become more apparent from the following detailed description of the embodiments when taken in conjunction with the accompanying drawings.

DESCRIPTION OF THE PREFERRED EMBODIMENTS

First embodiment [FIGS. 1 to 7]

Figure 1:
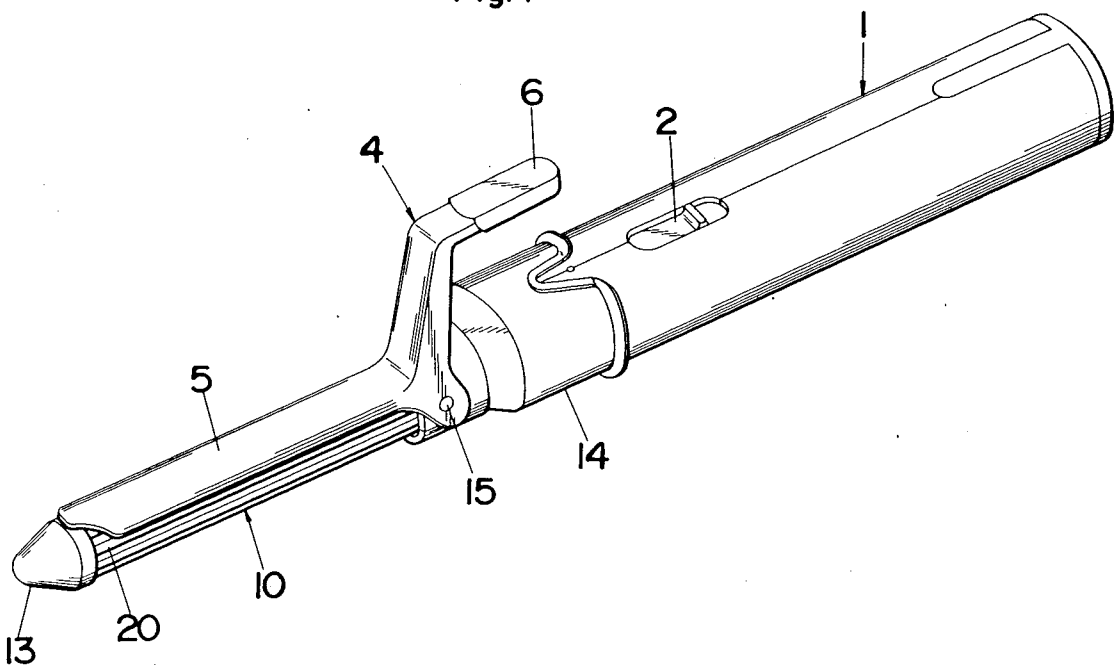
FIG. 1 is a perspective view of a hair curler in accordance with a first embodiment of the present invention.
Figure 2:
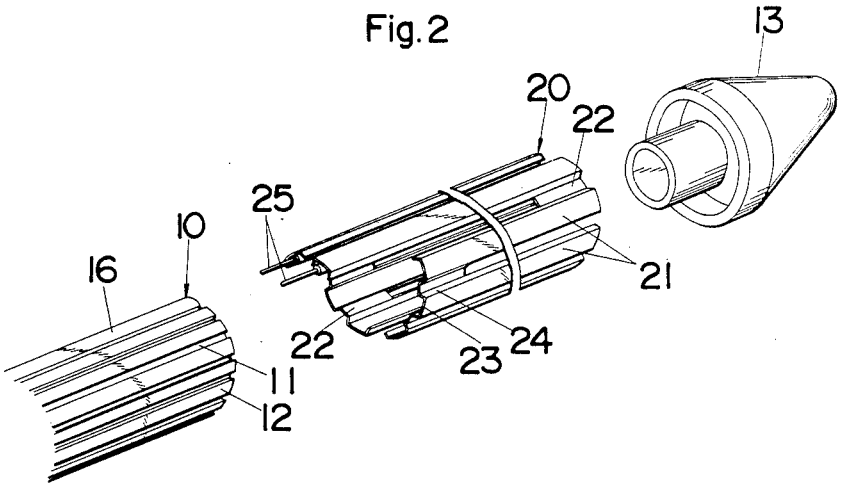
FIG. 2 is an exploded perspective view of a portion of the hair curler.
Figure 3:
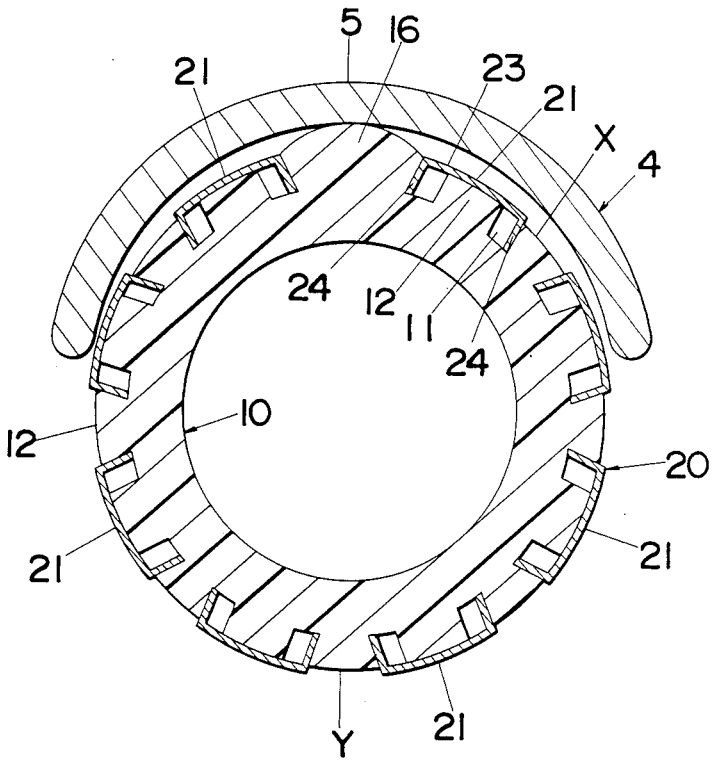
FIG. 3 is a cross sectional view of the hair curler.
Figure 4:
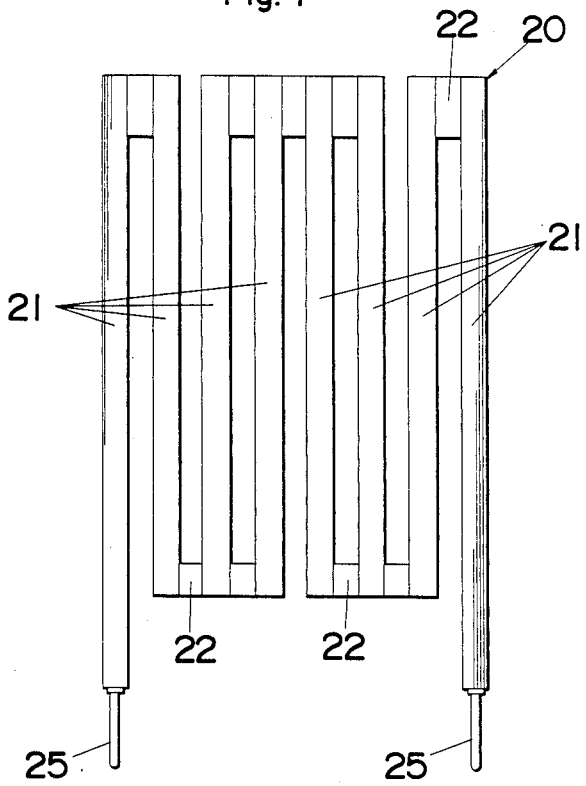
FIG. 4 is an extended plan view of a heating element employed in the hair curler.

Referring now to FIGS. 1 to 4, a hair curler in accordance with a first preferred embodiment of the present invention comprises a handle 1 to be grasped by the hand of a user and a barrel 10 coaxially extending from the handle 1. The barrel 10 is detachably connected to the handle 1 and carries thereon an electric heater or heating element 20 which is energized by an electric source such as a rechargeable battery incorporated in the handle 1 for curling the hair wound on the barrel 10. Mounted on the handle 1 is a switch slide 2 which actuates an electric switch 3 within the handle 1 for connecting the heating element 20 to the heat source and disconnecting it therefrom. The barrel 10 is shaped from a heat resistive plastic material having low thermal conductivity into a cylindrical hollow body with a plurality of longitudinally extending and circumferentially spaced channels 11 which define between the adjacent ones thereof corresponding ridges 12. A head cap 13 is secured to the front end of the barrel 10 to serve as a safety cool tip which may be supported by the other hand of the user during the hair curling treatment. Secured to the rear end of the barrel 10 is a joining cap 14 by which the barrel 10 is detachably connected to the front end of the handle 1. The joining cap 14 carries a pivot pin 15 which serves to pivotally mount a hair clamping member 4 with a clamping plate section 5 and an operator lever 6. The clamping member 4 is movable between a first position of FIG. 1 where the clamping plate section 5 is located closely adjacent to or placed over one circumferential portion of the barrel 10 for clamping hair to that portion of the barrel 10 and a second position where it extends at an angle from the barrel 10 to permit introduction and removal of the hair to and from the barrel 10. The clamping member 4 is biased by suitable spring means to the first position and is manipulated to the second position by depressing the operator lever 6 by the thumb of the user's hand grasping the handle 1. The clamping plate section 5 is made of a steel or like metal to extend the entire length of the barrel 10 as well as to have an arcuate cross section, as best shown in FIG. 3, so as to surround approximately one half of the circumference of the barrel 10 when moved to the first position.

The heating element 20 is formed from a metal sheeting of relatively high electric resistance such as nickel-chromium steel and the like metal sheeting to have a plurality of resistor segments 21 of uniform width and thickness which extend along substantially the entire length of the barrel 10 in generally parallel relationship with each other and which are integrally joined by a corresponding number of bridging piece 22. Each of the resistor segments 21 is shaped into a generally inverted U cross section with a pair of somewhat outwardly flaring legs 24 which depend downwardly from the opposite sides of a web 23, as shown in FIGS. 2 and 3, and are connected at the longitudinal ends thereof to the adjacent one of the resistor segments 21 by the bridging pieces 22.

The heating element 20 thus formed is wrapped on the barrel 10 in such a way that the webs 23 of the resistor segment 21 cover alternate one of the ridges 12 of the barrel 10 with the depending legs 24 being pressed against the side walls of the adjacent channels 11, as best shown in FIG. 3. The bridging pieces 22 at the longitudinal ends of the heating element 20 are received respectively in the head caps 13 and the joining cap 14 and are secured between the barrel 10 and these caps 13, 14. Thus, the web 23 of each resistor segment 21 is exposed on the exterior surface of the barrel 10 so as to be in direct heat transfer contact with the hair to be wounded on the barrel 10. In this connection, the web 23 of each resistor segment 21 projects to a slight extent above the exterior surfaces of the adjacent ridges 12 remaining uncovered by the resistor segments 21, or the general outer surface of the barrel 10 for ensuring constant heat transfer contact between the hair and the heating element 20. The edges on opposite sides of each web 24 are more or less rounded so as not to injure the skin of the user's head.

Figure 5:
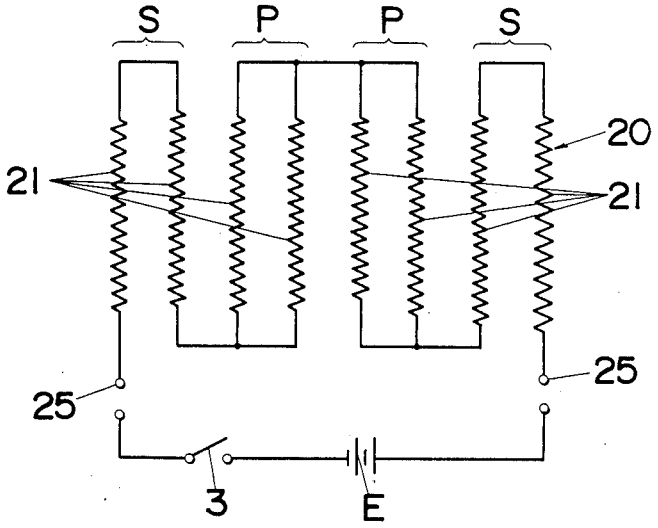
FIG. 5 is a schematic diagram of the electric connection of the hair curler.
Figure 6:
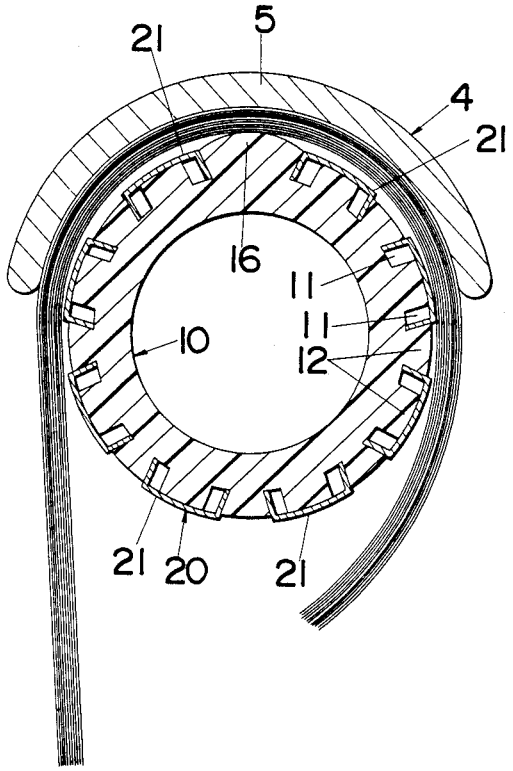
FIG. 6 is a cross sectional view similar to FIG. 3 but shows the hair clamped by a hair clamping member.

It is to be noted at this point that the resistor segments 21 and the bridging pieces 22 are of the same thickness, or made from the sheeting of uniform thickness, however, the effective width with respect to the current flow direction of the bridging piece 22 is much greater than the effective width of the resistor segment 21 so that the bridging piece 22 has a greater cross section and therefore much less electric resistance than the resistor segments 21. Accordingly, the resistor segments 21 alone can serve as a heat source while the bridging pieces 22 will not. Alternatively, the same effect can obtained by dimensioning the bridging pieces 22 to have a greater thickness than the resistor segments 21. A pair of terminal pins 25 are welded to the ends of the opposed resistor segments 21 and extend rearwardly through the joining cap 14 for connection with the electric source or rechargeable battery within the handle 1. As shown in FIG. 5, this electrical connection is made through the electric switch 3 which is actuated by the switch slide 2 on the handle 1, as previously described.

Figure 7:
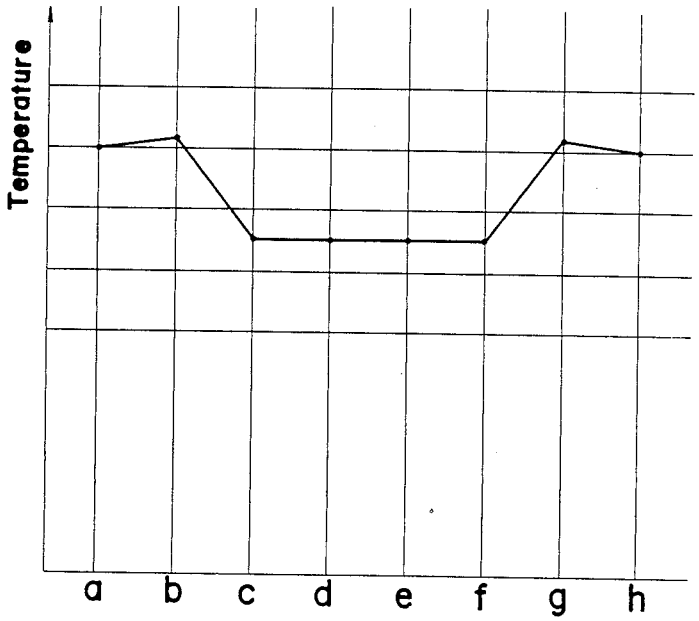
FIG. 7 is a graphical representation showing the temperature distribution around a barrel of the hair curler.

In the present embodiment, the heating element 20 is arranged such that the resistor segments 21 are electrically connected in series-parallel combination across the electric source or battery E, as shown in FIG. 5. That is, the resistor segments 21 form two pairs of series circuits denoted by S on the opposed ends of the heating element 20 and two pairs of parallel circuits denoted by P between the series circuits S. The resistor segments 21 forming the series circuits S are disposed on the portion X of the barrel 10 which is located closely adjacent to or to be surrounded by the clamping plate section 5 of the hair clamping member 4 in its first position, while the other resistor elements 21 forming the parallel circuits P are disposed on the remaining portion Y of the barrel 10 which is located away from or not surrounded by the clamping plate section 5. Consequently, the resistor segments 21 on the portion X produce a greater amount of heat than those on the other portion Y, as shown in FIG. 7 in which letters a to h on the abscissa correspond to the individual resistor segments 21 arranged in the order of from the left to the right in FIGS. 4 and 5. That is, the resistor segments 21 indicated by the letters a, b, g, and h are disposed on the portion X to be surrounded by the clamping plate section 5, while those indicated by the letters c, d, e, and f are on the other portion Y. With this scheme of producing a more amount of heat on the portion X than on the other portion Y, the hair held between the clamping plate section 5 and the portion X of the barrel 10 receives sufficient amount of heat from that portion X, even if a certain amount of heat is released therefrom to the clamping plate section 5, assuring an effective hair curling treatment. In other words, the above scheme acts to at least compensate for the heat loss due to the heat release to the clamping plate section 5, ensuring to supply enough heat to the hair clamped to the barrel 10.

For the purpose of reducing the above heat loss as much as possible, the barrel 10 is formed thereon with a stopper nub 16 which projects radially outwardly beyond the adjacent resistor segments 21 so as to abut against the clamping plate section 5, preventing the direct contact of the resistor segments 21 with the clamping plate section 5. The stopper nub 16 is molded integrally on one of the ridges 12 and extends along substantially the entire length of the barrel 10.

Figure 8:
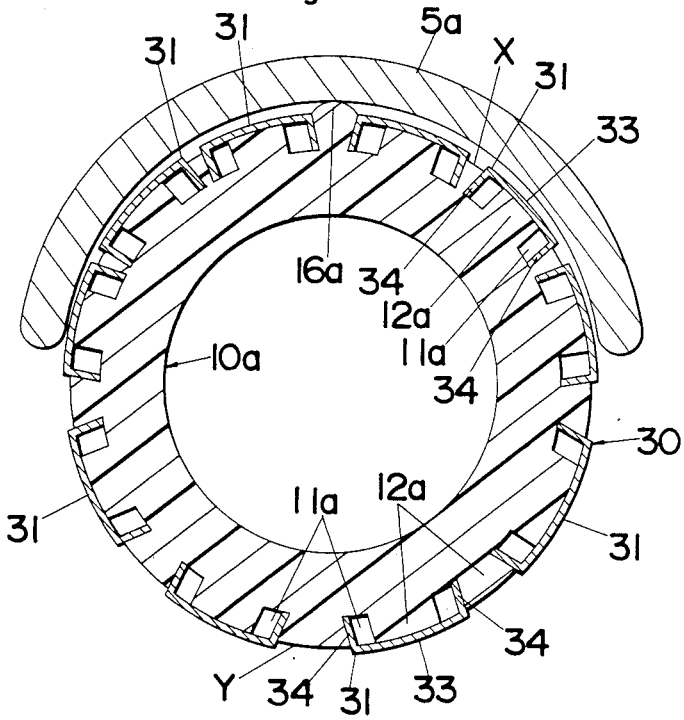
FIG. 8 is a cross sectional view of a hair curler in accordance with a second embodiment of the present invention.
Figure 9:
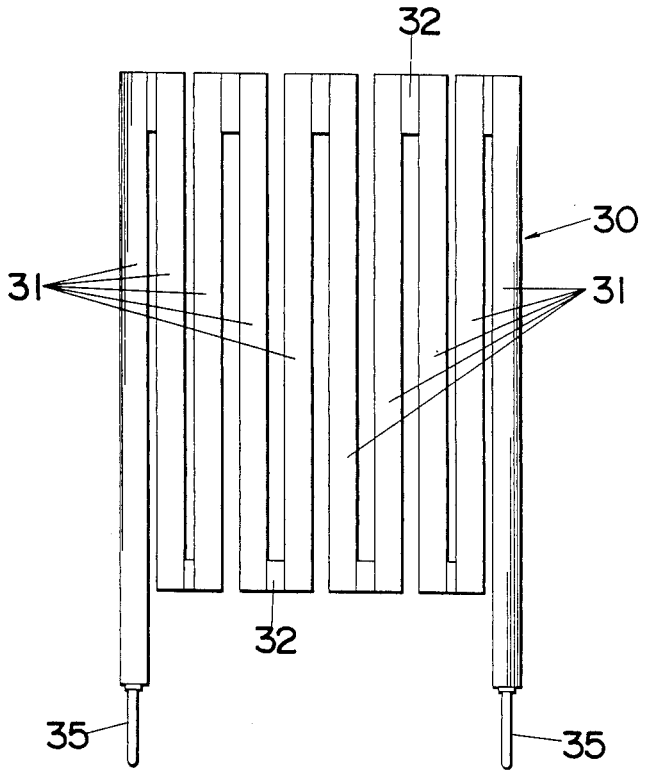
FIG. 9 is an expanded plan view of a heating element employed in the hair curler of FIG. 8.
Figure 10:
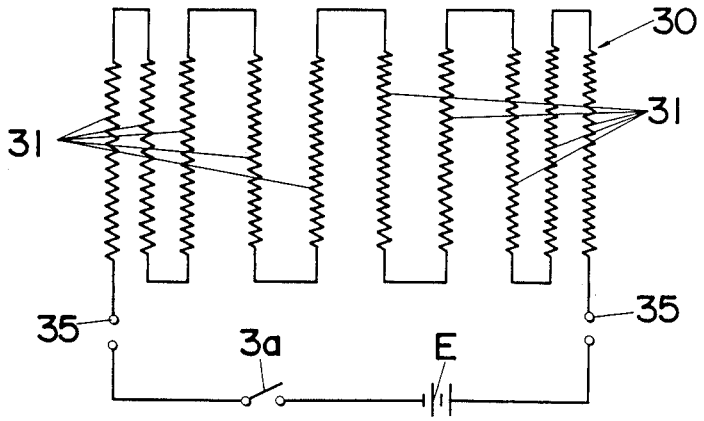
FIG. 10 is a schematic diagram of the electrical connection of the hair curler of FIG. 8.

Second Embodiment [FIGS. 8 to 10]

A hair curler in accordance with the second preferred embodiment is shown in FIGS. 8 to 10 to employ another form of a heating element 30. The other constructions are identical to those in the above first embodiment. The heating element 30 comprises a plurality of resistor segments 31 each connected at its one longitudinal end to the adjacent one of the resistor segment 31 by the bridging piece 32. The bridging pieces 32 are integrally formed with the resistor segments 31 and staggered on the opposite longitudinal ends of the heating element 30 so that the resistor segments 31 are serially connected by the bridging pieces 32 in a zig-zag manner to have an elongated heating path, as shown in FIGS. 9 and 10. The heating element 30 includes a pair of terminal pins 35 secured to the opposed resistor segments 31, which terminal pins 35 are used for connection of the heating element 30 with an electric source E through a like electric switch **3*a*, as shown in FIG. 10. The heating element 30 thus formed is mounted on the barrel 10*a* with the web 33 of each resistor segment 31 being placed over the corresponding ridges 12*a* of the barrel 10*a* and with the depending legs 34 at the opposite sides of each web 33 being pressed fitted in the channels 11*a***.

In the present embodiment, the resistor segments 31 mounted on the portion X of the barrel **10*a* adjacent to the clamping plate section 5*a* of like hair clamping member are spaced circumferentially at a closer interval than the remaining resistor segments 31 mounted on the other portion Y away from the clamping plate section 5*a*. Thus, the portion X of the barrel 10 can have a larger number of the resistor segments 31 per unit circumferential length than the other portion X so as to produce a greater amount of heat at that portion X, bringing about the same effect of the above first embodiment. Also in the second embodiment, like stopper nub 16*a* is integrally molded with the barrel 10*a* to prevent the direct contact of the resistor segments 31 with the clamping plate section 5*a***.

Figure 11:
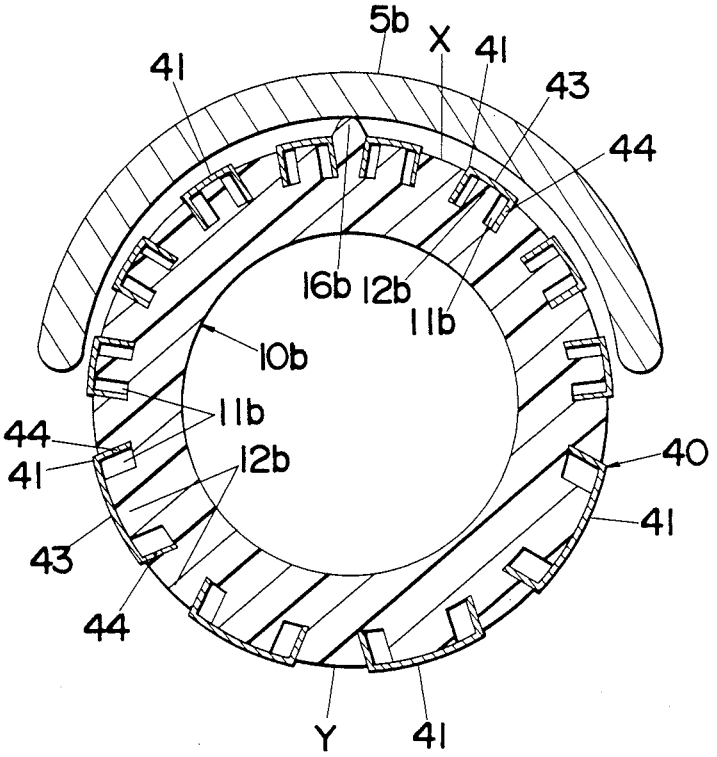
FIG. 11 is a cross sectional view of a hair curler in accordance with a third embodiment of the present invention.
Figure 12:
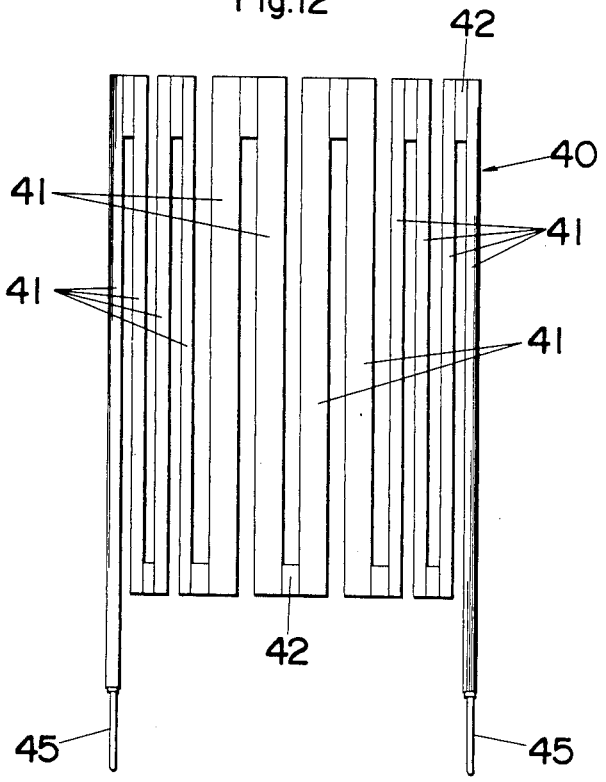
FIG. 12 is an expanded plan view of a heating element employed in the hair curler of FIG. 11.
Figure 13:
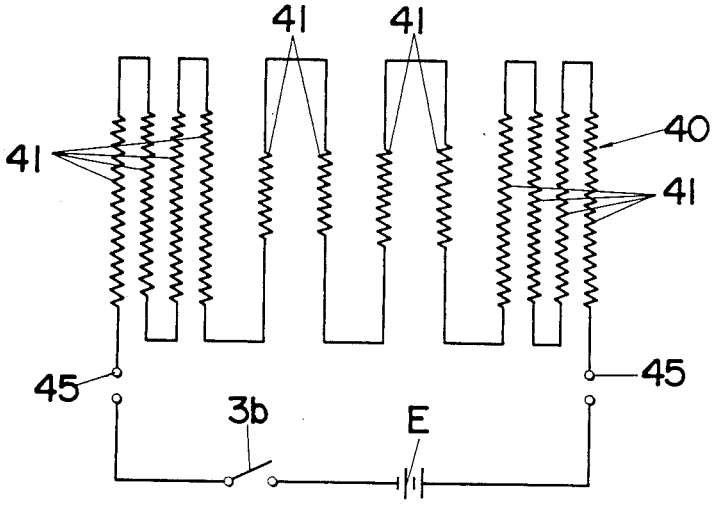
FIG. 13 is a schematic diagram of the electrical connection of the hair curler of FIG. 11.

Third embodiment [FIGS. 11 to 13]

Referring to FIGS. 11 to 13, there is shown a hair curler in accordance with a third preferred embodiment of the present invention which is identical in construction to the first and second embodiment except for a particular arrangement of a heating element 40. The heating element 40 has a plurality of resistor segments 41 which are arranged in the like fashion to those of the second embodiment and which are further characterized in that the resistor segments 41 spaced at a closer interval are of a narrower width than the remaining resistor segments 41 spaced at a wider interval. That is, the resistor segments 41 mounted on the portion X of a barrel **10*b* adjacent to the clamping plate section 5*b* of like hair clamping member have a narrower width and at the same time are spaced at a closer interval than the remaining resistor segments 41 mounted on the portion Y not surrounded by the clamping plate section 5*b*. Thus, the portion X is rendered to give off more heat than the other portion Y since the portion X has the resistor segments of greater electric resistance in addition to that it has a greater number of resistor segments 41 per unit circumferential length, amplifying to differentiate the amount of heat produced on the portion X from the portion Y. A like stopper nub 16*b* is integrally formed on the barrel 10*b* to prevent the direct contact of the resistor segments 41** to the clamping plate section 5*b* for the same purpose as described with reference to the first embodiment.

Also in the present embodiment, each of the resistor segments 41 is connected at its one longitudinal end to the adjacent one of the resistor segment 41 by an integrally formed bridging piece 42. The heating element 40 includes a pair of terminal pins 45 secured to the opposed resistor segments 41 for connection of the heating element 40 with an electric source E through a like electric switch 3*b*, as shown in FIG. 13. The heating element 40 thus formed is mounted on the barrel 10*b* with the web 43 of each resistor segment 41 being placed over the corresponding ridges 12*b* of the barrel 10*b* and with the depending legs 44 at the opposite sides of each web 43 being pressed fitted in the channels 11*b* of the barrel 10*b*.

What is claimed is:

1. A hair curler comprising a barrel provided with an electrical resistance heating element extending along the exterior thereof and a hair clamping member adapted to clamp hair to the heating element on the barrel;

said hair clamping member comprising a clamping plate section adapted to be placed over one circumferential portion of the barrel in closely adjacent relation thereto; and said heating element comprising a plurality of resistor segments connected in a series-parallel combination across an electric source, extend lengthwise of the barrel and are spaced circumferentially therearound, with said resistor segments on the portion of the barrel located away from the clamping plate section of said hair clamping member connected in parallel and said resistor segments mounted on the portion of the barrel located closely adjacent to said clamping plate section connected in series to produce a greater amount of heat at that section than the resistor segments connected in parallel on the portion of the barrel located away from the clamping plate section of said hair clamping member.

2. A hair curler as set forth in claim 1, wherein the barrel is provided with a stopper nub on the portion of the barrel located closely adjacent to the clamping plate section of said hair clamping member, said stopper nub projecting radially outwardly beyond the adjacent segments of the heating element and adapted for abutting engagement with the clamping plate section to prevent direct contact between the segments and the clamping plate section of the hair clamping member.

* * * * *